US008479917B1

(12) United States Patent
Harshman

(10) Patent No.: US 8,479,917 B1
(45) Date of Patent: Jul. 9, 2013

(54) CARRIER FOR VASE

(75) Inventor: Trent A. Harshman, Galveston, IN (US)

(73) Assignee: Syndicate Sales Inc., Kokomo, IN (US)

( * ) Notice: Subject to any disclaimer, the term of this patent is extended or adjusted under 35 U.S.C. 154(b) by 0 days.

(21) Appl. No.: 13/457,632

(22) Filed: Apr. 27, 2012

(51) Int. Cl.
*B65D 81/02* (2006.01)

(52) U.S. Cl.
USPC ..... 206/423; 206/493; 206/592

(58) Field of Classification Search
USPC ..... 206/423, 521, 586, 587, 588, 591, 206/592, 594, 493, 756, 759, 760
See application file for complete search history.

(56) References Cited

U.S. PATENT DOCUMENTS

| | | | | | |
|---|---|---|---|---|---|
| 2,664,670 | A * | 1/1954 | Mulford | 47/84 |
| 2,767,831 | A * | 10/1956 | Brecht | 206/423 |
| 2,809,745 | A * | 10/1957 | Bramming | 206/586 |
| 3,289,829 | A * | 12/1966 | Donahue | 206/426 |
| 4,067,442 | A * | 1/1978 | Howe | 206/433 |
| 5,156,277 | A * | 10/1992 | Witz | 206/592 |
| 5,743,393 | A * | 4/1998 | Webb et al. | 206/319 |
| 2002/0189963 | A1 * | 12/2002 | Weder et al. | 206/423 |
| 2003/0024851 | A1 * | 2/2003 | Auclair | 206/756 |

* cited by examiner

*Primary Examiner* — Jacob K Ackun
(74) *Attorney, Agent, or Firm* — Woodard, Emhardt, Moriarty, McNett & Henry LLP

(57) ABSTRACT

A container for holding a vase having flowers positioned therein. The container includes a pair of side walls, a pair of bottom retainers, and a downwardly extending tongue to limit relative motion between the vase and container.

18 Claims, 4 Drawing Sheets

CARRIER FOR VASE

BACKGROUND OF THE INVENTION

1. Field of the Invention

The present invention relates generally to the field of packaging for vases.

2. Description of the Prior Art

Vases are typically shipped within corrugated boxes with corrugated separators dividing the box into individual compartments, one each for each vase. A separate container is not used for each vase since the vases are shipped in quantity thereby providing a more efficient delivery means. In certain instances there is a need for a separate container for holding a single vase as it is delivered to a destination.

Flowers are typically delivered to the end recipient by wrapping the flowers within tissue paper. In the event a vase is to accompany the flowers then the vase may be held separately within bubble wrap or a foam type construction.

Disclosed herein is an attractive presentation whereby the flower stems are inserted within a vase with the vase then being held by an outer wrap or container as the combination of flowers, vase and shipping container is delivered. Such a container must be both inexpensive and easily assembled to hold the vase in place while allowing the flower stems to be placed at least partially inside the vase thereby protecting the vase and flowers as they are transported to the recipient.

SUMMARY OF THE INVENTION

One embodiment of the present invention is a vase/container combination of a vase having a continuous side wall with an open top end and a closed bottom end with the vase removably held within the container. The container has a main body with a pair of sides, a bottom portion and a top portion. The bottom end of the vase is positioned above the bottom portion of the container whereas the top end of the vase is positioned between the pair of sides and by the top portion of the container. The top portion of the container has a pivotable portion removably extending downwardly into the open top of the vase to limit relative movement between the top end of the vase and the container. The container further has a pair of retainers located between the pair of sides with the vase positioned between the retainers to limit relative motion between the bottom end of the vase and the bottom portion of the container.

It is an object of the present invention to provide a container that will hold a single vase having flowers therein for delivery to a recipient.

A further object of the present invention is to provide new and improved packaging for delivery of a glass or plastic container.

Yet a further object of the present invention to provide an inexpensive and readily assembled container for holding a vase during transportation thereof.

In addition, it is an object of the present invention to provide a corrugated wrap that holds a vase in place while allowing for flowers to be placed inside during shipment.

Related objects and advantages of the present invention will be apparent from the following description.

DESCRIPTION OF THE PREFERRED EMBODIMENT

Figure 1:
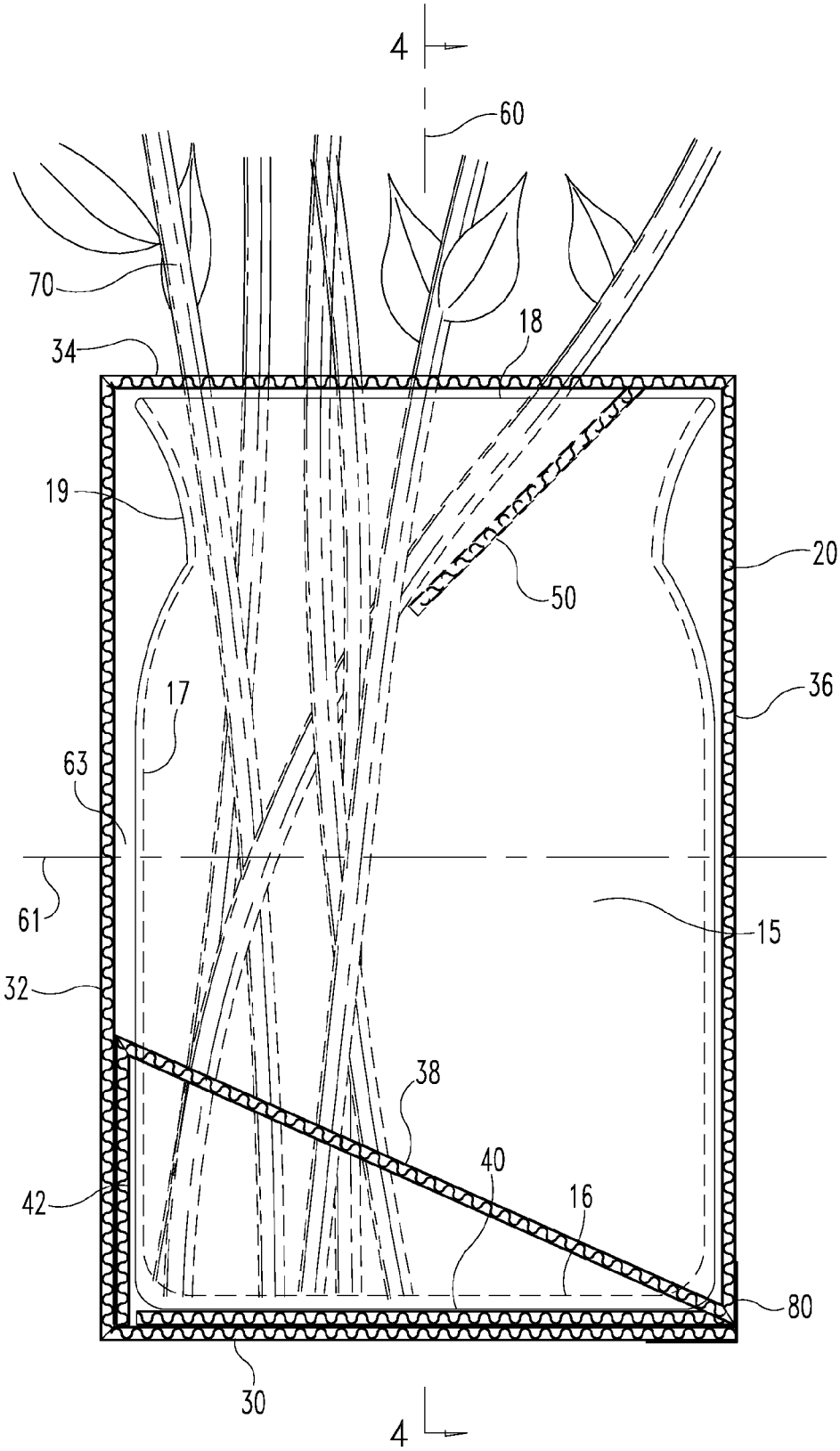
FIG. 1 is a front view of a container for holding a vase having flowers therein.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
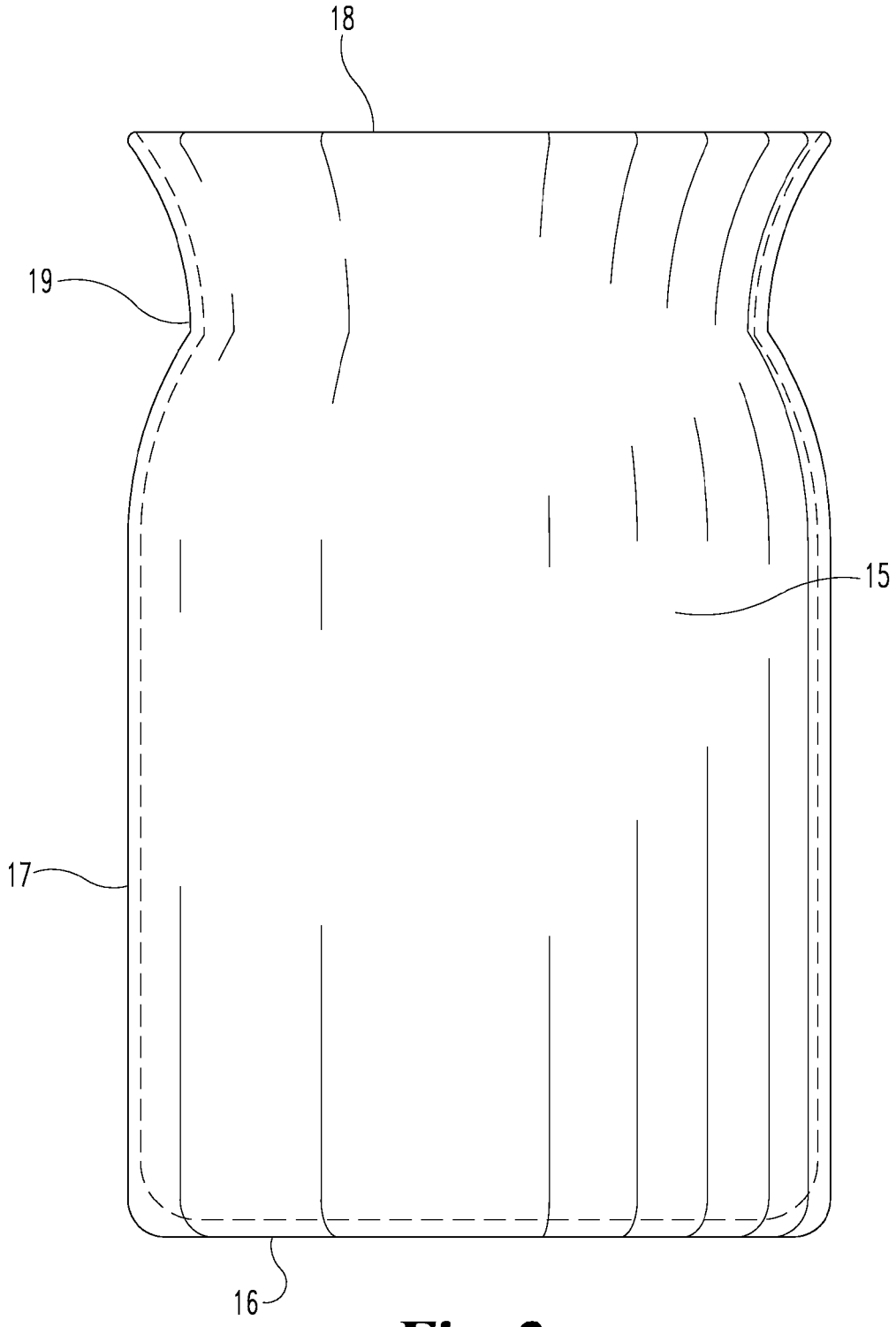
FIG. 2 is an enlarged front view of a vase held by the packaging shown in FIG. 1.

Referring to FIG. 1, a corrugated container 20 is shown holding a vase 15 having the stems of flowers 70 extending into the vase. Vase 15 (FIG. 2) may be produced from glass or plastic and includes a bottom wall 16 integrally joined to a continuous side wall 17 with the vase having an indented portion 19 surrounding the vase adjacent the top portion of the vase. The vase has an open top 18 in which the stems of the flowers may be inserted.

Figure 3:
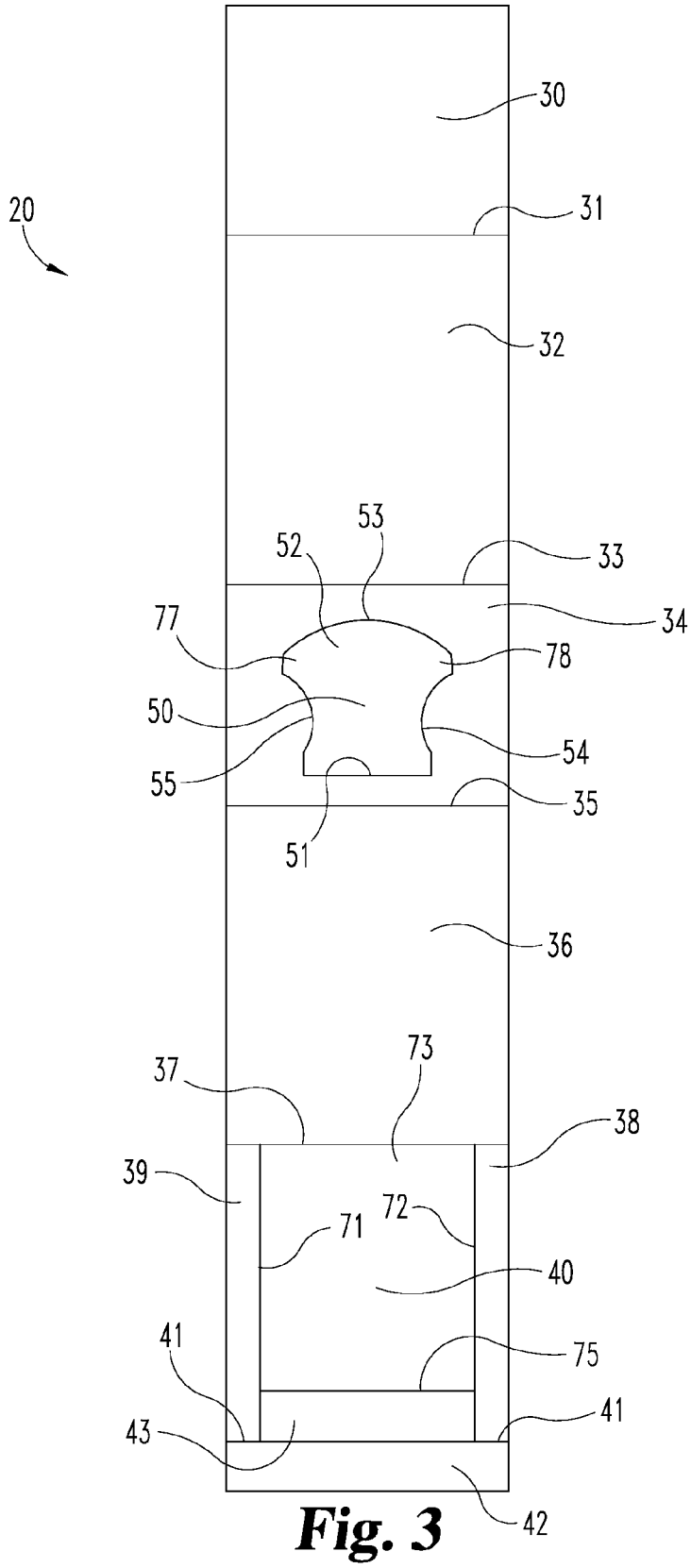
FIG. 3 is a reduced, plan view of a strip of corrugated paperboard that is cut and then folded in place to form the container of FIG. 1.

The packaging or container 20 is shown in FIG. 3 in an unassembled state and is produced from a single piece of corrugated paperboard and folded along various lines to the final configuration shown in FIG. 1. The main body of the container or wrap 20 has a bottom wall 30 forming a first end portion of the strip. Bottom end portion 30 is eventually placed beneath the bottom wall 16 of the vase. A first side wall 32 is connected between the bottom wall 30 and the top wall or top portion 34 of the strip. Fold line 31 separates bottom wall 30 from side wall 32, whereas fold line 33 separates side wall 32 from the top portion 34. A second side wall 36 is connected to the top portion 34 of the strip and is separated therefrom by fold line 35. Once the strip is folded along the various fold lines, side walls 32 and 36 extend along the opposite sides and the length of vase 15 with top wall 34 extending by and over the top of the vase. Fastening device 80, such as tape, removably engages side wall 36 and wall 30 of the container securing the container 20 in the final configuration wrapping around the vase. Side walls 32 and 36 thereby limit side ways movement along axis 61, relative to container 20.

Figure 4:
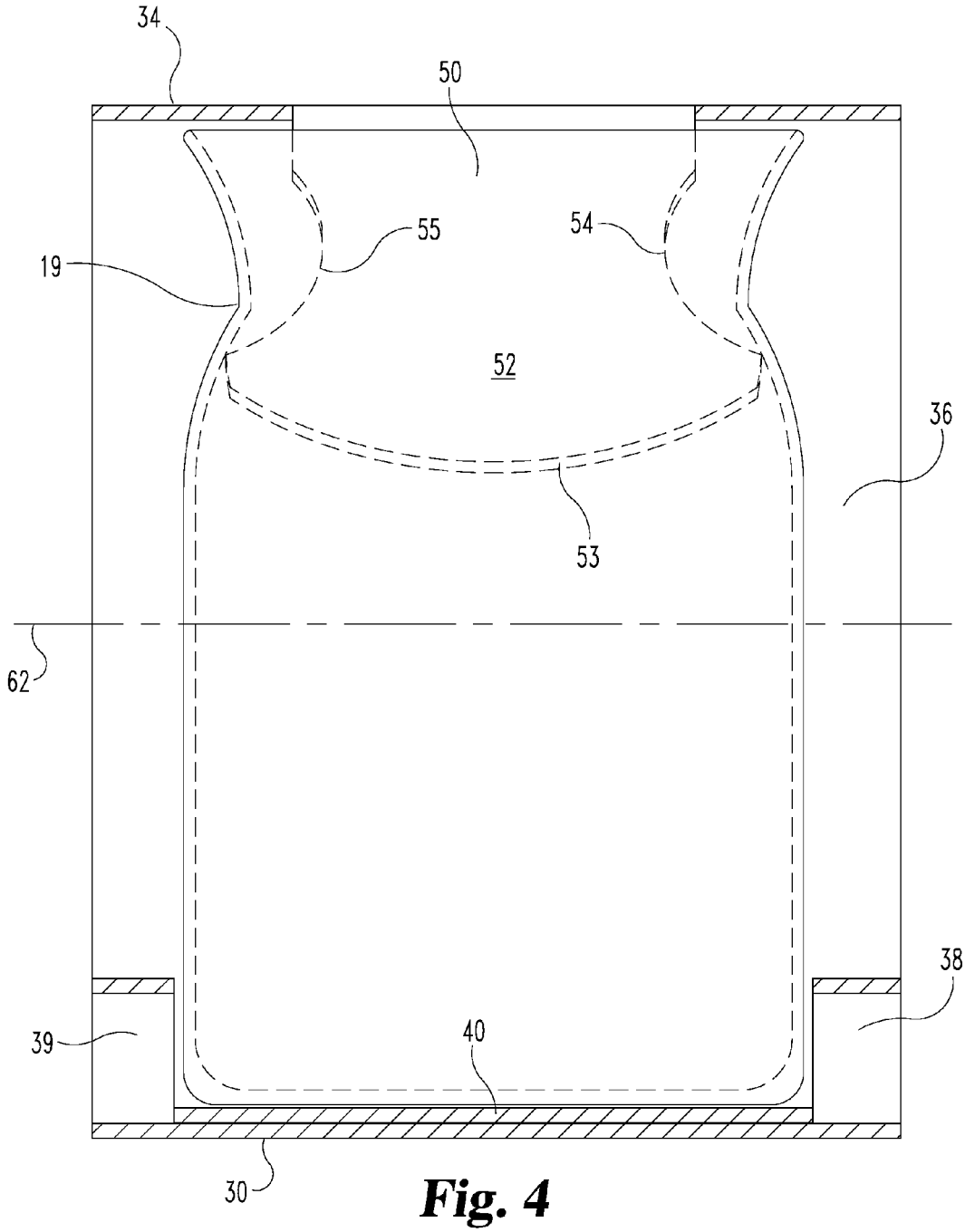
FIG. 4 is an enlarged cross-sectional view taken along the line 4-4 of FIG. 1 and viewed in the direction of the arrows.

A pair of retainers 38 and 39 is integrally attached to side wall 36 and joined thereto along fold line 37. The opposite ends of retainers 38 and 39 are likewise integrally joined to spacing wall 42 along fold line 41. Spacing wall 42 forms the second end portion of the strip of corrugated material used to form container 20. Retainers 38 and 39 extend upwardly from the bottom of side wall 36 until they abut side wall 32 with spacing wall 42 then extending downwardly adjacent side wall 32 with the distal end of spacing wall 42 being located so as to be in contact with container bottom wall 30. Retainers 38 and 39 are in contact with the opposite sides of vase 15 and limit relative motion along axis 62 (FIG. 4) relative to container 20. Spacing wall 42 extends parallel and in contact with wall 32 and is spaced apart from side wall 36, the approximate width of vase 15 thereby limiting relative motion of the vase along axis 61 relative to side walls 32 and 36. Vase side wall 17 is in contact with spacing wall 42 and is spaced apart from container side wall 32 by gap 63. Thus, side walls 32 and 36 in conjunction with spacing wall 42 and retainers 38 and 39 stabilize sideways movement of the vase.

Wall 40 has a proximal end 73 (FIG. 3) joined to side wall 36 and extends along fold line 37. The opposite proximal end 75 of wall 40 is spaced apart from spacing wall 42 thereby providing a gap 43 there between. The opposite edges 71 and 72 of wall 70 are severed from retainers 38 and 39 allowing bottom wall 42 to extend horizontally (FIG. 1) whereas retainers 38 and 39 extend upwardly. Bottom wall 16 of the vase rests atop wall 40 of the container 20.

The one piece strip forming container 20 limits movement of the vase relative to the container. In particular, walls 32 and 36 along with spacing wall 42 limit relative motion between the vase and the container in the direction of axis 61 (FIG. 1), which is perpendicular to axis 62, while retainers 38 and 39 limiting sideways movement of the vase along axis 62. Further limitation of the movement of the vase is provided by top wall 34 along with a tongue shaped portion 50. Top wall 34 extends over the top edge of the vase thereby limiting relative motion of the vase relative to the container along axis 60 (FIG. 1), which is perpendicular relative to axis 61. Tongue shaped portion 50 includes a proximal end 51 (FIG. 3) integrally joined to top wall 34 with a fold line 51 positioned there between allowing the tongue 50 to be forced down into the neck of the vase. The tongue has a distal end portion 52 with a curved edge 53 joined to the side edges 54 and 55 of the tongue. The tongue is severed along edges 53 through 54 from top portion 34 and is shaped to engage the necked down portion 19 (FIG. 4) of the vase. The side walls 17 of the vase extend vertically upward toward the top of the vase and then inwardly forming the neck down portion 19. The outwardly protruding ears 77 and 78 of the tongue, positioned respectively between edges 55 and 53 and edges 54 and 53 engage the inside facing surface of the neck down portion of the vase thereby limiting relative motion of the vase relative to the container along axis 62. Likewise, the ears 77 and 78 may be positioned slightly beneath the neck down portion 19 of the vase thereby limiting relative motion between the container and the vase along axis 60.

The stems of the flowers 70 extend into the vase with the top end of the flowers being positioned outwardly of the vase. Tongue 50 has a distal edge 53 located approximately at the center line of the vase when it is pivoted down thereby engaging the stems of the flowers and urging the flowers towards the oppositely facing vase side wall securely holding the flowers in the vase as the container, vase and flowers are transported to the final receiver of the flowers. The container has only a pair of side walls 32 and 36 thereby allowing one to see through the vase in a direction along axis 62. In order to remove the vase and flowers from the container, a conventional device, such as tape 80 is removed from the container thereby allowing the container to be unwrapped from the vase while tongue 50 is pivoted further into the vase so as to not damage flower stems.

Many variations are contemplated and included in the present invention. For example, the strip forming container 20 may be produced from corrugated paperboard material or plastic material. Other configurations are also anticipated in forming container 20.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. The vase/container combination of:

a vase having a continuous side wall with a open top end and a closed bottom end; and, a container with said vase removably held therein, said container has a main body with a pair of sides, a bottom portion and a top portion, said bottom end of said vase being positioned above said bottom portion of said container whereas said top end of said vase being positioned between said pair of sides and by said top portion of said container, said top portion of said container has a pivotable portion removably extending downwardly into said open top of said vase to limit relative movement between said top end of said vase and said top portion of said container, said container further having a pair of retainers located between said pair of sides with said vase positioned between said retainers to limit relative motion in a first direction between said bottom end of said vase and said bottom portion of said container.

2. The combination of claim 1 wherein:

said continuous wall of said vase has a necked down portion located between said top end and said bottom end, said pivotable portion of said container is reduced in width extending into and receiving said necked down portion and has an enlarged distal end positioned internally in said vase adjacent said continuous side wall beneath said necked down portion limiting relative motion between said necked down portion of said vase and said container.

3. The combination of claim 1 wherein:

said main body of said vase has a top wall extending over and atop said top end of said vase cooperatively with said bottom portion of said container limiting relative motion between said vase and said container.

4. The combination of claim 1 wherein:

said main body is a one piece construction having a first portion located beneath said vase, a first side wall connected between said first portion and said top portion of said container, a second side wall connected to said top portion with said vase positioned between said first side wall and said second side wall of said container, a pair of retainers connected to said second side wall and extending from said second side wall toward said first side wall with said vase positioned between said retainers, a spacing wall connected to said retainers and spacing said vase apart from said first side wall of said containers.

5. The combination of claim 1 wherein:

said pair of sides includes a first side wall and a second side wall, said main body of said container includes an spacing wall located between said first side wall and said vase spacing said vase apart from said first side wall while urging said vase against said second side wall limiting relative motion between said vase and said container in a second direction perpendicular to said first direction.

6. The combination of claim 5 wherein:

said continuous side wall of said vase has a necked down portion located between said top end and said bottom end, said pivotable portion of said container is reduced in width receiving said necked down portion and has an enlarged distal end positioned within said vase adjacent said continuous side wall against said necked down portion limiting relative motion between said necked down portion of said vase and said container.

7. The combination of claim 6 wherein:

said main body of said vase has a top wall extending over and atop said top end of said vase cooperatively with said bottom portion of said container limiting relative motion between said vase and said container.

8. A vase and container for holding the vase comprising:

a vase having a continuous side wall with a open top end and a closed bottom end; and, a container to removably hold said vase, said container has a main body with a pair of sides, a bottom portion, and a top portion, said bottom end of said vase being positioned above said bottom portion of said container whereas said top end of said vase being positioned between said pair of sides and by said top portion of said container, said pair of sides of said main body includes a first side wall and a second side wall, said main body of said container includes a spacing wall located between said first side wall and said vase spacing said vase apart from said first side wall while urging said vase against said second side wall limiting relative motion between said vase and said container in a first direction.

9. The vase and container of claim 8 wherein:

said continuous side wall of said vase has a necked down portion located between said top end and said bottom end, said top portion of said container has a locking portion removably extending downwardly into said open top end of said vase to limit relative movement between said top end of said vase and said top portion of said container, said locking portion of said container is reduced in width extending into and receiving said necked down portion and has an enlarged distal end positioned internally in said vase adjacent said continuous side wall beneath said necked down portion limiting relative motion between said necked down portion of said vase and said container.

10. The vase and container of claim 9 wherein:

said container further having a pair of retainers located between said pair of sides with said vase positioned between said retainers to limit relative motion in a second direction perpendicular to said first direction.

11. The vase and container of claim 10 wherein:

said main body of said vase has a top wall extending over and atop said top end of said vase cooperatively with said bottom portion of said container limiting relative motion between said vase and said container in a third direction perpendicular to said first direction and said second direction.

12. The vase and container of claim 11 wherein:

said main body is a one piece corrugated construction.

13. A shipping container comprising:

a one-piece main body foldable from a flat condition to an erected position and having, when in said erected position, a first side wall and a second side wall spaced apart from said first side wall, a bottom portion, and a top portion with a pivotable portion extending toward said bottom portion, said main body further having a spacing wall and a pair of retaining walls located between said first side wall and said second side wall, said main body sequentially including, when in said erected position said bottom portion connected to said first side wall, said first side wall connected to said top portion, said top portion connected to said second side wall, said second side wall connected to said pair of retaining walls, said retaining walls connected to said spacing wall, said retaining walls extend from said second side wall toward said first side wall with said spacing wall located adjacent said first side wall and inwardly of said first side wall and said second side wall.

14. The shipping container of claim 13 wherein:

said bottom portion and said second side wall are removably connected together when in said erected position.

15. The shipping container of claim 14 and further comprising:

a seating wall integrally connected to said second side wall and located between said retainers with said seating wall when in the erected position extending from said second side wall toward said first side wall and adjacent said bottom portion.

16. The shipping container of claim 15 wherein said main body is produced of corrugated material.

17. The shipping container of claim 13 wherein:

said pivotable portion has a proximal end connected to said top portion and an enlarged distal end with said pivotable portion forming a pair of outwardly extending locking ears.

18. The shipping container of claim 17 wherein:

said spacing wall when in the erected position extending adjacent and parallel to said first side wall and located between said first side wall and said second side wall.

* * * * *